United States Patent [19]

Zaremba et al.

[11] Patent Number: 5,031,407

[45] Date of Patent: Jul. 16, 1991

[54] APPARATUS FOR USE IN A FUEL DELIVERY SYSTEM FOR A GAS TURBINE ENGINE

[75] Inventors: Henry V. Zaremba, Tempe; Lonnie J. Lucas, Chandler; Paul B. Catmull, Gilbert; Maynard L. McAdams, Chandler; Karl P. Johnson, Tempe, all of Ariz.

[73] Assignee: Allied-Signal Inc., Morris Township, Morris County, N.J.

[21] Appl. No.: 362,182

[22] Filed: Jun. 6, 1989

[51] Int. Cl.[5] ..... F02C 7/22

[52] U.S. Cl. ..... 60/739; 60/740

[58] Field of Search ..... 60/39.31, 734, 739, 60/740, 741, 746

[56] References Cited

U.S. PATENT DOCUMENTS

| | | | |
|---|---|---|---|
| 2,944,388 | 7/1960 | Bayer . | |
| 3,159,971 | 12/1964 | Moebius et al. . | |
| 3,472,025 | 10/1969 | Simmons et al. | 60/740 |
| 3,516,252 | 6/1970 | Udell et al. | 60/739 |
| 3,879,940 | 4/1975 | Stenger . | |
| 3,973,395 | 8/1976 | Markowski et al. | 60/746 |
| 4,201,046 | 5/1980 | De Negris et al. . | |
| 4,466,240 | 8/1984 | Miller . | |
| 4,467,610 | 8/1984 | Pearson et al. | 60/739 |
| 4,903,478 | 2/1990 | Seto et al. | 60/746 |

*Primary Examiner*—Louis J. Casaregola

*Attorney, Agent, or Firm*—Joseph R. Black; James W. McFarland; Robert A. Walsh

[57] ABSTRACT

A fuel manifold (70) for a gas turbine engine is formed from a plurality of spaced bodies (10) and interconnecting conduits (72). The bodies (10) are adapted to provide fluid communication between the conduits (72) and a corresponding plurality of nozzle assemblies (62) which are removably secured to the bodies. The nozzle assemblies (62) can thereby be detached from a structure (58) to which the manifold (70) is secured, while all components (10, 72) of the manifold (70) remain secured to the structure (58) and to each other. A fail-safe sealing member (32) adapted for use with the fuel manifold-/nozzle assembly combination (70, 62) is also disclosed.

13 Claims, 3 Drawing Sheets

FIG. 5
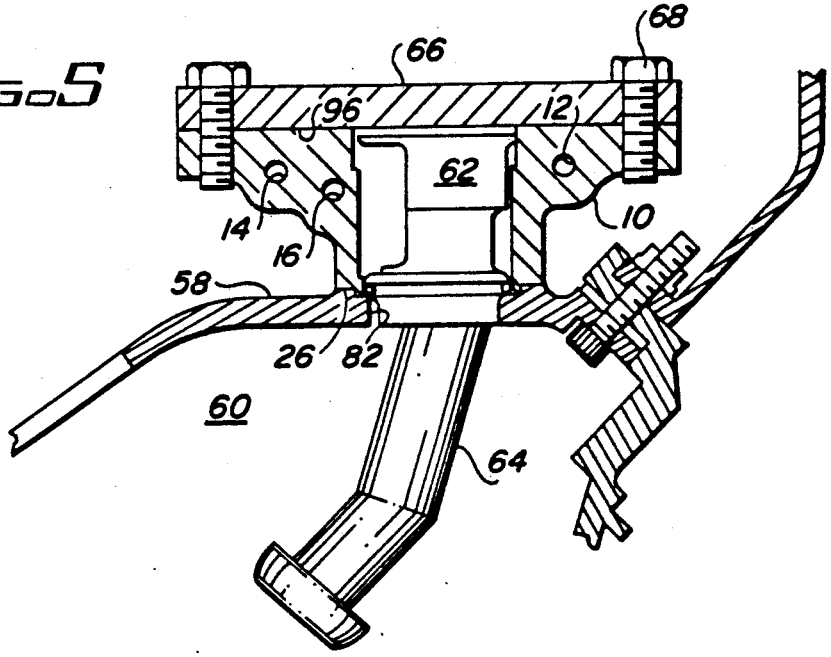
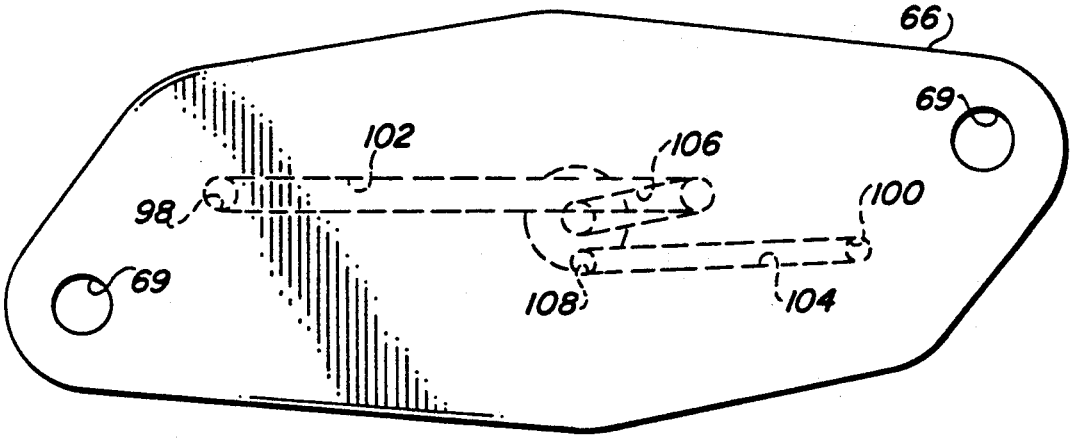
FIG. 6
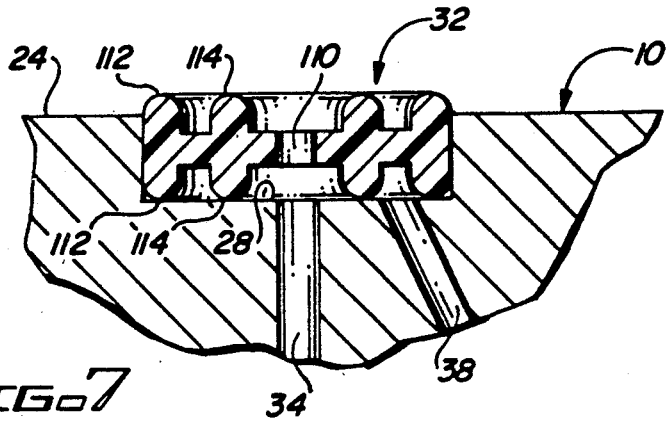
FIG. 7

APPARATUS FOR USE IN A FUEL DELIVERY SYSTEM FOR A GAS TURBINE ENGINE

TECHNICAL FIELD

This invention relates generally to gas turbine engines and more specifically to fuel manifolds and components thereof which are employed in such engines.

BACKGROUND OF THE INVENTION

The maintenance of gas turbine engines requires occasional removal of fuel nozzles from nozzle/manifold assemblies for inspection. In some engine designs this may require partial dismantlement of the engine, but even for those which have easily accessible nozzle/-manifold assemblies, the task of removing and replacing nozzles is made cumbersome by the design of the assembly itself. For example, in order to remove a single nozzle it may be necessary to disconnect a number of spaced nozzle assemblies so that fuel lines are sufficiently flexible to permit withdrawal of the nozzle from the combustor.

U.S. Pat. No. 4,466,240 Miller discloses a fuel nozzle structure with external and internal removal capability. Referring to FIG. 1 of the patent, the nozzle support structure 35 is secured to a plenum-defining structure 12 (the structure 12 being referred to as a "combustor") which surrounds a combustion chamber 20. The nozzle 10 may be disconnected internally of the plenum-defining structure 12 by retracting bolts 64 which secure the nozzle to a fuel line 42. In addition to disconnecting the nozzle 10, this disconnects the fuel line 42 from the plenum-defining structure 12 (See col. 2, lines 64–66). When the nozzle 10 is replaced, the fuel line 42 must be repositioned for securement by the bolts 64. Conversely, the nozzle 10 may be disconnected externally of the structure 12 by retracting bolts 34. This requires that the entire nozzle support structure 35 and fuel line 42 be separated from the structure 12.

Since fuel nozzles are a high-maintenance item in comparison to manifolds, it is desirable to remove nozzles without having to separate fuel conduits or other portions of the manifold from the structure to which the manifold is secured. This result can be achieved by use of the present invention.

An objective of the present invention is to provide greater facility in the maintenance of gas turbine engines.

SUMMARY OF THE INVENTION

The invention accomplishes the forementioned objective by providing apparatus adapted to enable the removal of nozzle assemblies from a fuel manifold without having to disconnect components that, when connected, form the manifold, and without having to disconnect any portion of the manifold from a structure to which the manifold is secured.

The invention further provides a fail-safe sealing member adapted for use with the apparatus.

BRIEF DESCRIPTION OF THE DRAWINGS

FIG. 5 is a generally cross-sectional view taken along line 5—5 of FIG. 4, and illustrates securement of a single nozzle assembly to a single one of the bodies illustrated in FIG. 1. The nozzle portion of the nozzle assembly is shown in elevation.

FIG. 6 is a top elevational view in which dashed lines illustrate fluid communication in a nozzle support member of the nozzle assembly.

FIG. 7 is a cross-sectional view illustrating a sealing member adapted for use with the fuel manifold and nozzle assemblies illustrated in FIG. 3.

DESCRIPTION OF THE PREFERRED EMBODIMENT

Figure 2:
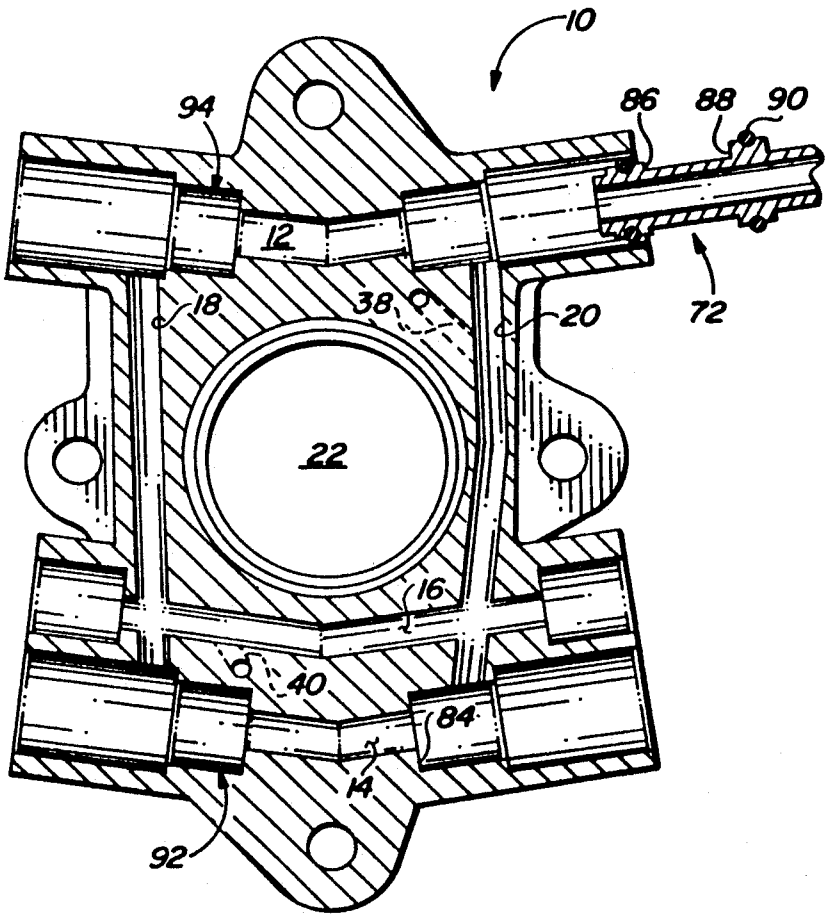
FIG. 2 is a cross-sectional view of the body illustrated in FIG. 1, taken in a plane parallel to the sheet.
Figure 1:
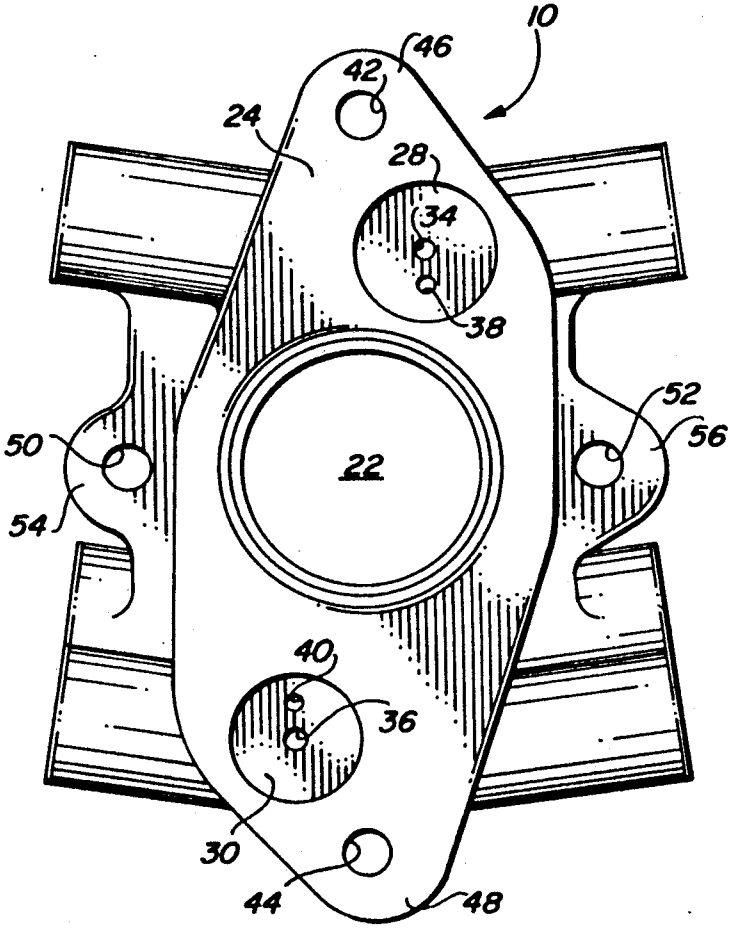
FIG. 1 is a top elevational view of a body adapted for constructing a fuel manifold in accordance with the preferred embodiment of the invention.

FIGS. 1 and 2 illustrate a body 10 which is a component of a fuel manifold for a gas turbine engine. The body 10 has a primary fuel supply channel 12, a secondary fuel supply channel 14, and a drain channel 16 formed therein by stepped boring. Partially plugged cross-bores form bypass channels 18, 20 connecting the supply channels 12, 14 to the drain channel 16. A relatively large bore forms a hole 22 extending from a first surface 24 to a generally oppositely-facing second surface 26 (FIG. 5). Stepped bores form seating surfaces 28, 30 for seals 32 (FIG. 7), and feed channels 34, 36 extending from the supply channels 12, 14 to the first surface 24. Angled bores extending from the seating surfaces 28, 30 to the bypass channels 18, 20 provide secondary bypass channels 38, 40 for fluid communication from the feed channels 34, 36 to the drain channel 16 in the event of a seal failure. Tapped bores 42, 44 are provided through bosses 46, 48, and bores 50, 52 are provided through bosses 54, 56. The latter bores 50, 52 are provided for securement of the body 10 to a typically annular structure 58 (FIG. 5) which defines a plenum 60 (FIG. 5) surrounding a combustion chamber (not shown) of a gas turbine engine (not shown). The former bores 42, 44 are provided for securement of a nozzle assembly to the body 10. The body 10 is preferably formed as an integral unit and composed of a suitable titanium alloy. By the supply and drain channels 12, 14, 16, the body 10 is adapted to form portions of a primary fuel supply line, a secondary fuel supply line, and a drain line. By the feed channels 34, 36, the body 10 is adapted to provide fluid communication from the supply channels 12, 14 to a nozzle assembly. By the hole 22, the body 10 is adapted to receive a nozzle therethrough, and by tapped bores 42, 44 the body is adapted for securement of the nozzle assembly thereto.

The main advantage provided by the body 10 is that it enables construction of a fuel manifold for a gas turbine engine, wherein nozzle assemblies secured to the manifold may be independently removed without disconnecting components of the manifold from each other, and without disconnecting those components from a structure (such as the structure 58) to which the manifold is secured. In use, a nozzle assembly 62 comprising a nozzle 64 and a nozzle support member 66 is secured to the body 10 by bolts (as at 68) extending through bores 69 in the support member and engaging the tapped bores 42, 44 (See FIGS. 5 and 6).

Figure 3:
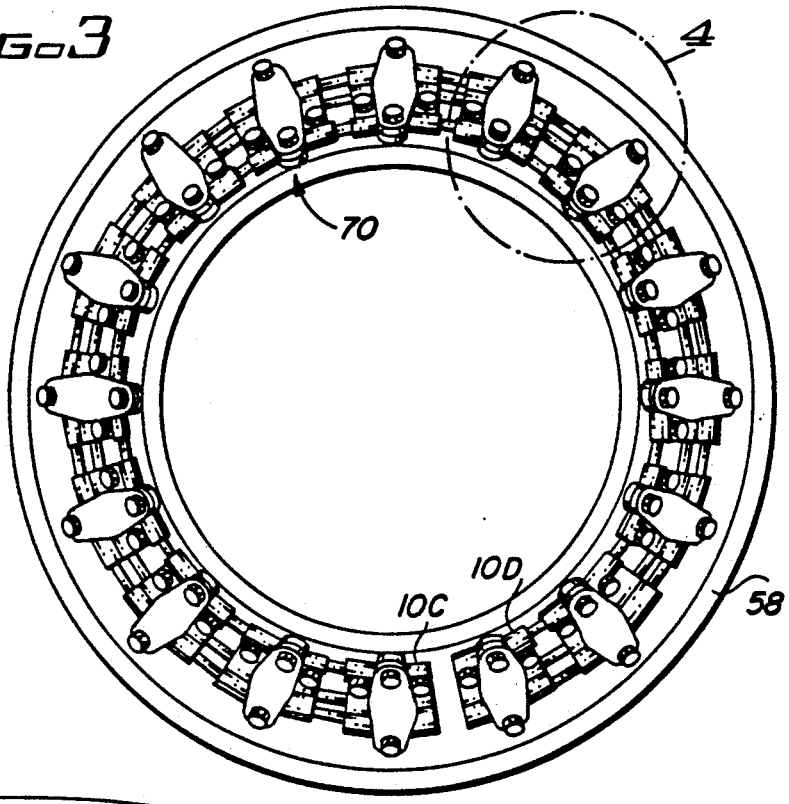
FIG. 3 is a perspective view of a fuel manifold combination with a plurality of nozzle assemblies secured to the manifold.
Figure 4:
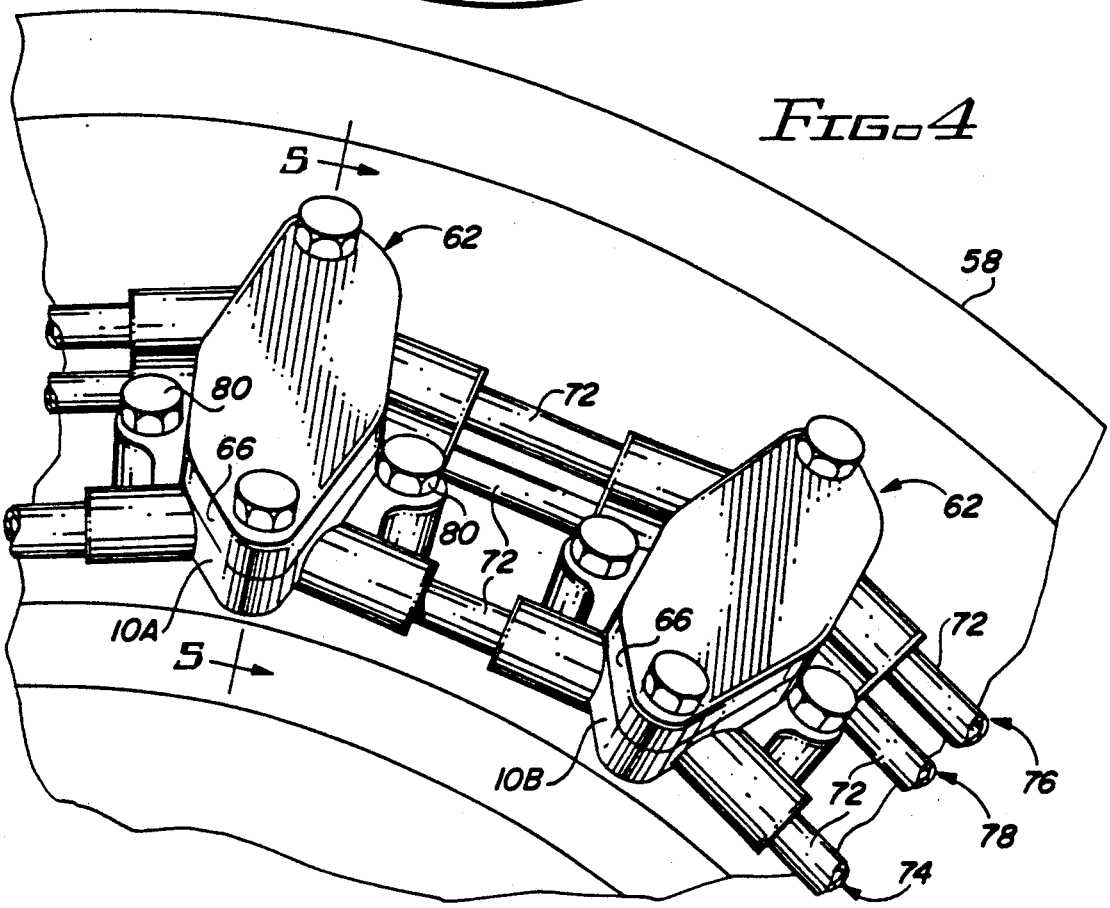
FIG. 4 is an enlargement of the indicated portion of FIG. 3.

Referring now to FIGS. 3 and 4, a fuel manifold 70, shown with a plurality of nozzle assemblies 62 secured thereto, comprises a plurality of the bodies 10 and a plurality of conduits (as at 72). The bodies 10 and conduits 72 are interconnected to define a primary supply line 74, a secondary supply line 76, and a drain line 78. In constructing the manifold 70, each of the bodies 10 is secured to the structure 58 with the first surface 24 (FIG. 1) facing outwardly therefrom (away from the structure). Securement is effected by bolts 80 extending through the bores 50, 52 (FIG. 1) and engaging tapped bores (not shown) formed in the structure 58. At the securement locations of the bodies 10, the structure has holes 82 (FIG. 5) aligned with the holes 22 (FIG. 1) formed in the bodies. Between the securement of one body 10A and an adjacent body 10B, three conduits are inserted into the supply and drain channels of the adjacent pair of bodies. This process is repeated until the entire fuel manifold 70 is formed, except that two adjacent bodies 10C, 10D have their channels 12, 14, 16 plugged on one side and have no conduits extending therebetween.

Referring to FIGS. 2 and 4, the conduits 72 extend into the channels 12, 14, 16 almost to the lands (as at 84) formed by the stepped bores. Each conduit 72 in the supply lines 74, 76 has two generally annular bosses (as at 86 and 88) with recesses for seating O-seals 90. These are suitably located on the conduits 72 so that the bypass channels 18,20 intersect the supply channels 12, 14 between the seals 90. Each conduit 72 in the drain line 78 has a single annular boss and O-seal. Fuel delivered from the source (not shown) through a suitable flow control valve (not shown) is supplied to the manifold 70 (FIG. 3) through one of the bodies 10. Accordingly, one of the bodies 10 has a tapped bore which receives a fitting connecting the primary supply line 74 with the source, and a second tapped bore which receives a fitting connecting the secondary supply line 76 with the source. These bores (not shown) are suitably located so that fuel enters the supply channels 12, 14 at positions (indicated by arrows 92, 94) which are between the innermost seals 90 of the conduits 72. One of the conduits 72 in the drain line 78 is provided with a T-fitting (not shown) through which fuel is either dumped or returned to the source.

Referring to FIGS. 5 and 6, the nozzle support member 66 has channels formed therein for providing fluid communication from the body 10 to the nozzle 64. Bores 98, 100 extending from the bottom surface 96 of the support member 66 into its interior intersect partially plugged cross-bores 102, 104, which in turn intersect bores 106, 108 leading back to the bottom surface 96. The nozzle 64 is secured to the support member 66 by any suitable means so that the latter bores 106, 108 are aligned with passages (not shown) formed in the nozzle. The former bores 100, 98 are so located at the bottom surface 96 that they align with the primary and secondary feed channels 34, 36 of the body 10.

FIG. 7 illustrates a generally annular sealing member 32 adapted for use with the manifold 70 and nozzle assemblies 62. The sealing member 32 is seated on the seating surface 28 and has axially-extending holes (as at 110) providing fluid communication from the feed channel 34 to the bore 100 (FIG. 6) formed in the nozzle support member 66. A sealing member 32 is also provided on the other seating surface 30 (FIG. 1). Each sealing member 32 has a radially-outermost opposing pair of annular bosses 112, and a radially-innermost opposing pair of annular bosses 114. Axially-extending holes (not shown) are provided between the annular bosses 112, 114. When the nozzle assembly 62 is secured to the body 10, the radially-innermost pair of bosses 114 function as a primary seal that prevents leakage between the first surface 24 of the body 10 and the bottom surface 96 of the nozzle support member 66. In the event of failure of the primary seal, the radially-outermost pair of bosses 112 function as a secondary seal which prevents the forementioned leakage. Because the primary and secondary seals are positioned on either side of the secondary bypass channels 38, 40, a failure of a primary seal results in flow to the drain channel 16 (FIG. 2). If the flow is appropriately routed and dumped outboard of the engine nacelle (not shown), failure of the primary seal can be detected by visual inspection.

The reader should understand that the foregoing text and accompanying drawings are not intended to restrict the scope of the invention to specific details which are ancillary to the teaching contained herein. Accordingly, the invention should be construed in the broadest manner which is consistent with the following claims and their equivalents.

What is claimed is:

1. In a fuel delivery system for a gas turbine engine, apparatus secured to a structure which surrounds a combustion chamber, the apparatus comprising:

a body having a first surface adapted to interface with a nozzle assembly and a second surface adapted to interface with the structure; the body having a plurality of channels formed between the surfaces; the body further having a hole extending from the first surface to the second surface for receiving a fuel nozzle; the channels including a primary supply channel, a secondary supply channel and a drain channel extending through the body in directions sufficiently parallel to the first and second surfaces to avoid intersection therewith; the channels further including feed channels extending from the supply channels to the first surface; the body being adapted via the supply and drain channels to receive six conduits and, via the feed channels to provide fluid communication between the supply channels and the nozzle assembly; the body further being adapted for securement of the nozzle assembly thereto.

2. Apparatus as recited in claim 1 further comprising in combination with the body:

a plurality of the bodies, the bodies being spaced and collectively substantially surrounding a portion of the structure;

a first plurality of conduits, each extending into the primary supply channels of an adjacent pair of the bodies;

a second plurality of conduits, each extending into the secondary supply channels of an adjacent pair of the bodies; and a third plurality of conduits, each extending into the drain channels of an adjacent pair of the bodies, whereby the conduits and the bodies form a fuel manifold.

3. Apparatus as recited in claim 2 further comprising in combination with the fuel manifold:

a plurality of nozzle assemblies, each being in fluid communication with and removably secured to a different one of the bodies, whereby the nozzle assemblies can be detached from the structure while the bodies remain secured to the latter and the conduits remain extended into the respective channels of the bodies.

4. Apparatus for use in delivering fuel to a combustion chamber of a gas turbine engine, wherein the combustion chamber is radially surrounded by a plenum-defining structure, the apparatus comprising:

a first plurality of conduits for forming a primary fuel supply line;

a second plurality of conduits for forming a fuel drain line;

a third plurality of conduits for forming a secondary fuel supply line;

a plurality of spaced nozzle assemblies, each comprising a nozzle and a nozzle support member; each support member having first and second channels formed therein;

a plurality of spaced bodies secured to the plenum-defining structure and cooperating with the conduits to form the lines; the bodies, nozzle assemblies, and conduits being intersecured in such manner that the nozzle assemblies are removable from the bodies while maintaining securement between the conduits and the bodies, and between the bodies and the plenum-defining structure; the bodies being adapted to provide for fluid communication between the nozzle assemblies and the supply lines; each body having a plurality of channels formed therein and comprising a primary feed channel in communication with the primary fuel supply line, a secondary feed channel in communication with the secondary fuel supply line, and secondary drain channels in communication with the fuel drain line; each body being secured to an associated one of the nozzle support members so that the primary and secondary feed channels are in fluid communication with the first and second channels, respectively.

5. Apparatus as in claim 4 further comprising a plurality of sealing members, each cooperating with one of the nozzle support members and its associated body to prevent leakage as fuel flows from the primary feed channel of the body to the first channel of the support member.

6. Apparatus as in claim 5 wherein each of the sealing members has an axially-extending hole for providing fluid communication from the primary feed channel to the first channel, and two pairs of radially-spaced bosses defining primary and secondary seals for preventing leakage.

7. Apparatus as in claim 6 wherein each of the sealing members is configured and positioned with respect to the body so that failure of the primary seal effects redirection of fuel from the primary feed channel to a secondary drain channel while the secondary seal prevents leakage.

8. Apparatus as in claim 7 wherein the sealing member is generally annular in shape and seated in the associated body.

9. Apparatus as recited in claim 3 further comprising a plurality of annular sealing members; each sealing member cooperating with one of the bodies and its associated nozzle assembly to prevent leakage as fuel flows from the body to the nozzle assembly; each sealing member having an axially extending hole formed therethrough for permitting the fluid communication; and each sealing member comprising two oppositely-facing pairs of radially-spaced bosses defining primary and secondary seal.

10. Apparatus as recited in claim 9 wherein each of the bodies has two separate recesses extending from the first surface to separate seating surfaces; each recess being dimensionally adapted to receive one of the sealing members so that when one of the pairs of bosses abuts the seating surface, the oppositely-facing pair of bosses abuts the associated nozzle assembly.

11. Apparatus as in claim 1 wherein the body defines two separate recesses extending from the first surface to separate seating surfaces in fluid communication with separate ones of the supply channels; the recesses forming portions of the feed channels.

12. Apparatus as in claim 11 wherein the channels further include two interior bypass channels connecting the supply channels to the drain channel, and two secondary bypass channels connecting the feed channels to the bypass channels.

13. Apparatus as in claim 12 wherein the secondary bypass channels intersect the feed channels at the seating surfaces.

* * * * *